US008403382B2

(12) United States Patent
Della-Santa

(10) Patent No.: US 8,403,382 B2
(45) Date of Patent: Mar. 26, 2013

(54) RETRACTABLE DOOR STOPPER

(75) Inventor: Pierre Della-Santa, Lonay (CH)

(73) Assignee: Delta Tursysteme AG, Zurich (CH)

( * ) Notice: Subject to any disclaimer, the term of this patent is extended or adjusted under 35 U.S.C. 154(b) by 138 days.

(21) Appl. No.: 12/993,633

(22) PCT Filed: Nov. 12, 2008

(86) PCT No.: PCT/CH2008/000477
§ 371 (c)(1),
(2), (4) Date: Jan. 18, 2011

(87) PCT Pub. No.: WO2009/143636
PCT Pub. Date: Dec. 3, 2009

(65) Prior Publication Data

US 2011/0101711 A1 May 5, 2011

(30) Foreign Application Priority Data

May 25, 2008 (CH) ..... 0776/08

(51) Int. Cl.
*E05C 17/56* (2006.01)
*E05C 19/16* (2006.01)

(52) U.S. Cl. ..... 292/251.5; 292/DIG. 15; 16/82

(58) Field of Classification Search ..... 292/251.5, 292/DIG. 15; 16/82
See application file for complete search history.

(56) References Cited

U.S. PATENT DOCUMENTS 1,895,146 A * 1/1933 Brown ..... 292/228
2,475,226 A * 7/1949 Ellis ..... 24/303
2,497,697 A * 2/1950 Smith ..... 292/74
3,330,585 A * 7/1967 Pollin ..... 292/164
3,805,322 A * 4/1974 Serrano ..... 16/82
4,343,500 A * 8/1982 Steiner ..... 292/175
4,462,623 A * 7/1984 Grant ..... 292/175
4,505,502 A * 3/1985 Tomita ..... 292/251.5
4,631,776 A * 12/1986 King ..... 16/82
4,702,038 A * 10/1987 Frey ..... 49/478.1
4,797,970 A * 1/1989 Charlton ..... 16/82
5,010,622 A * 4/1991 Morita ..... 16/85
5,018,241 A * 5/1991 Baines ..... 16/82
5,120,093 A * 6/1992 Carney ..... 292/60
5,395,143 A * 3/1995 Chesterton ..... 292/57
(Continued)

FOREIGN PATENT DOCUMENTS

JP 03063370 A * 3/1991
JP 06221045 A * 8/1994
(Continued)

*Primary Examiner* — Carlos Lugo
(74) *Attorney, Agent, or Firm* — Rankin, Hill & Clark LLP

(57) ABSTRACT

A retractable stopper, for example a door stopper, includes a tilting element that is rotatably supported about a rotation axis and that can be moved from a retracted position into a blocking position by the action of at least one trigger magnet, which is fastened to a moving object, and in the blocking position blocks the movement of the moving object. The tilting element includes a front lever, on which a preferably elastic buffer element is disposed. In the blocking position, the buffer element faces the moving object. A stopper magnet is disposed at the tilting element. As the trigger magnet approaches a vicinity region in front of the stopper, the tilting element can be rotated out of the retracted position into the blocking position due to the action of the trigger magnet on the stopper magnet before the trigger magnet is located above the tilting element.

12 Claims, 3 Drawing Sheets

U.S. PATENT DOCUMENTS

| | | | | |
|---|---|---|---|---|
| 5,775,746 | A * | 7/1998 | Charlton | 292/219 |
| 5,836,049 | A * | 11/1998 | Chiang | 16/82 |
| 5,890,751 | A * | 4/1999 | Seffinga | 292/67 |
| 6,321,411 | B1 * | 11/2001 | Ikejiri et al. | 16/82 |
| 6,336,245 | B1 * | 1/2002 | Sakakibara | 16/82 |
| 2011/0049911 | A1 * | 3/2011 | Bosshard | 292/251.5 |
| 2012/0043769 | A1 * | 2/2012 | Llanes | 292/259 R |

FOREIGN PATENT DOCUMENTS

| | | |
|---|---|---|
| JP | 11-287062 | 10/1999 |
| JP | 2000-192707 | 7/2000 |

* cited by examiner

RETRACTABLE DOOR STOPPER

BACKGROUND OF THE INVENTION

1. Field of the Invention

The invention relates to the field of door stoppers, in particular of door stoppers which can be sunk in the floor.

2. Description of Related Art

Retractable door stoppers are known per se: U.S. Pat. No. 6,321,411, and Japanese patent applications having the application numbers JP 2000-233665, JP 2000-019329, JP 2000-112559, JP 2000-299229, JP 2005-537873, JP 2007-837763, respectively, show door stoppers which can be sunk in the floor, in which a magnet is fastened in or to a moving door. When the door with the magnet is above the door stopper, the latter is drawn upward directly or by a lever mechanism and engages on the door. JP 2000-192707 A1 shows a door stopper which is very flat and is raised only a little way upward, so that the door must enter into a position very close to the door stopper.

The previously known door stoppers require a small vertical distance between door and door stopper, and hence appropriate structural conditions and a precise fitting of the door, and/or present an injury risk in the opened state.

BRIEF SUMMARY OF THE INVENTION

The object of the invention is therefore to provide a retractable door stopper of the type stated in the introduction, which eliminates the above-stated drawbacks.

The retractable stopper comprises a tilting element, which is mounted rotatably about a rotational axis and which can be moved from a retracted position into a blocking position by the action of at least one trigger magnet, fastened to a moving object, and in this blocking position blocks the movement of the moving object. The tilting element comprises a front lever, on which a preferably elastic buffer element is disposed. This serves as a stop for the moving object. In the blocking position, the buffer element is facing the moving object. A stopper magnet or a magnetizable element is disposed on the tilting element. As the trigger magnet approaches in an approach region in front of the stopper, the tilting element is rotatable out of the retracted position into the blocking position by the action of the trigger magnet on the stopper magnet or magnetizable element, and is rotated before the trigger magnet is above the tilting element.

It thereby becomes possible to design a very stable and reliable stopper, in particular a door stopper: since the stopper is tilted up before the moving object, for instance the door, is above the stopper, the stopper can be tilted relatively far upward. It is hence, in turn, able to detain the door (or, in general terms, the moving object) by its outer surface, and does not have to engage on the door by means of a specially shaped, potentially weak counterpart. Furthermore, a relatively large gap between the door and the floor can be surmounted by virtue of the tilted-up stopper. A greater field of application of the stopper is thereby enabled and tolerances in the positioning of the door may be greater. For instance, the vertical distance between the door stopper and the lower door edge with the trigger unit can measure up to 2 cm or more.

In a preferred embodiment of the invention, the tilting element comprises a front lever and a rear lever, which lie opposite each other with respect to the rotational axis. As a result of the action of the trigger magnet on the rear lever, the front lever is moved into a position in which it blocks the movement of the moving object. Preferably, the stopper magnet or the magnetizable element is disposed on or fastened to the rear lever. When the trigger magnet is present in an approach region in front of the stopper, the stopper magnet or the magnetizable element exerts on the tilting element a force which draws the rear lever downward and thereby tilts the front lever upward. In other words, the stopper magnet is, thus, drawn in the direction of the trigger magnet and the rear lever is thereby through-rotated to beneath the rotational axis and, thus, the front lever with the buffer element is rotated upward.

As a consequence, the door stopper, thus, has a very simple design comprising only one moving part (in addition to the door).

In a preferred embodiment of the invention, over the full range of the rotation angle, an outer contour of the buffer element follows the shape of an inner contour of the cover plate. In other words, the shape of the buffer element is configured correspondingly to the shape of the opening in the cover plate at the place where this opening comprises an edge situated opposite the buffer element: regardless of the rotation angle, a substantially constant short distance, hence, lies between the buffer element and the inner margin of the cover plate. The distance is preferably 0.5 mm to 2 mm. Injuring of fingers or wedging of items between the buffer element or tilting element and other parts of the door stopper is thereby avoided.

Mathematically speaking, the shape of that surface of the buffer element which is facing the moving object is thus defined by rotation of a boundary line about the rotational axis of the tilting element. The shape can be a spherical segment or a segment of a spheroid, a cylinder of revolution, etc.

A rotation angle through which the tilting element is pivotable from the retracted position into the blocking position preferably measures between 40° and 90°, preferably between 60° and 90°.

In a further preferred embodiment of the invention, an upper side of the front lever, in the retracted position, is aligned with a fixedly mounted cover plate and butts in the blocking position against an upper limit configured on the cover plate. Alternatively or additionally, in the blocking position, a stop can also be present in the housing.

Preferably, on the cover plate and/or on the upper side of the front lever there is arranged an outer stop element for cushioning the impact of the front lever against the upper limit in the blocking position.

In a further preferred embodiment of the invention, on a bottom side of the cover plate and/or on a top side of the rear lever, there is arranged an inner stop element for cushioning the impact of the rear lever against the cover plate in the retracted position.

In a further preferred embodiment of the invention, the trigger magnet is an electromagnet. Alternatively or additionally, the door stopper magnet can also be an electromagnet. The tilting up of the door stopper then happens only when the magnet is switched on, i.e. is live. When the magnet is switched off, the trigger magnet passes over the door stopper without the tilting element being moved. Furthermore, the moving object, in particular a door, when the electromagnet is switched on or powered, can be held in abutment against the stopper. If the power to the electromagnet is removed, the door is released and can be closed by a door closer. The automatic closure of a fire protection door can thus be realized. Upon closure of the door, the door stopper falls into the retracted position and no longer presents an obstacle.

Preferably, the housing and/or the tilting element is formed of aluminum or another non-ferromagnetic material, so that the magnetic forces are not diverted. Preferably, the cover plate is also formed of stainless steel. The tilting element with the front lever and the rear lever is preferably configured in one piece and bears the attached buffer element and the stopper magnet.

In a further preferred embodiment of the invention, the tilting element is arranged rotatably about the rotational axis in a housing, the housing comprises an upper housing part and a lower housing part, and, for the fitting of the stopper in a foundation, first the lower housing part can be fastened in the foundation and then the upper housing part can be detachably fastened to the lower housing part. It, thus, becomes possible to open the door stopper for cleaning purposes, in which case the lower housing part can remain fixedly anchored in the foundation.

BRIEF DESCRIPTION OF THE DRAWINGS

The subject of the invention is explained in greater detail below with reference to preferred illustrative embodiments represented in the appended drawings, in which, respectively in schematic representation.

The reference symbols used in the drawings and the meaning thereof are listed in summarized form in the reference symbol list. In the figures, the same parts are basically provided with the same reference symbols.

DETAILED DESCRIPTION OF THE INVENTION

Figure 1:
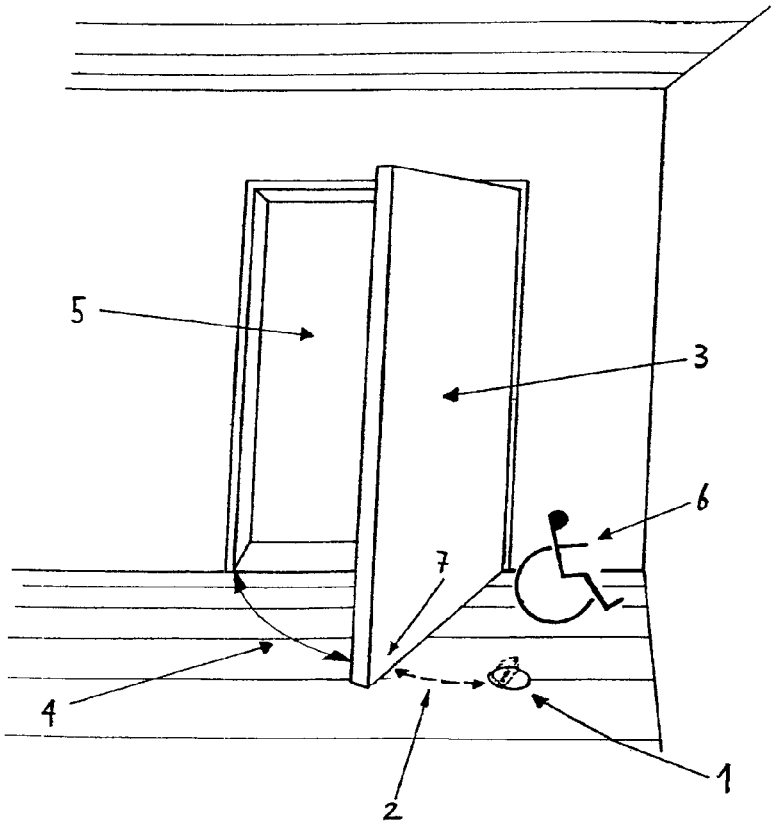
FIG. 1 shows a general view of an application of a retractable door stopper.

FIG. 1 shows a general view of an application of a retractable door stopper 1. The door stopper 1 is embedded in a floor or foundation 15 and is disposed, for instance, in front of a doorway 5 of the door in the region of a line of movement 4 along which a part of the lower edge of a door leaf 3 moves. When the door is closed, the door stopper 1 is retracted and hence presents no obstacle to, for instance, a wheelchair 6. On the lower edge of the door leaf 3, there is arranged a magnetic trigger unit 7. Through the movement of the door leaf 3, the trigger unit 7 is moved into a region above the door stopper 1. In an approach region 2 of the line of movement 4, the trigger unit 7 acts on the door stopper 1 and tilts up a buffer element 13, so that the door leaf 3 butts against the buffer element 13.

Figure 2:
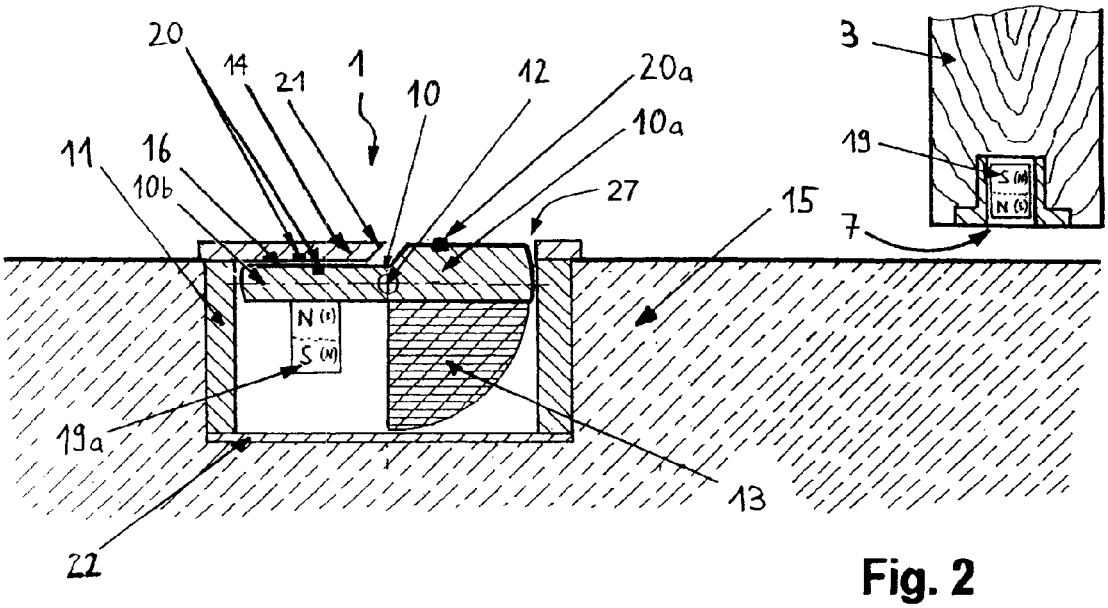
FIG. 2 shows the door stopper in a retracted position in cross section.
Figure 3:
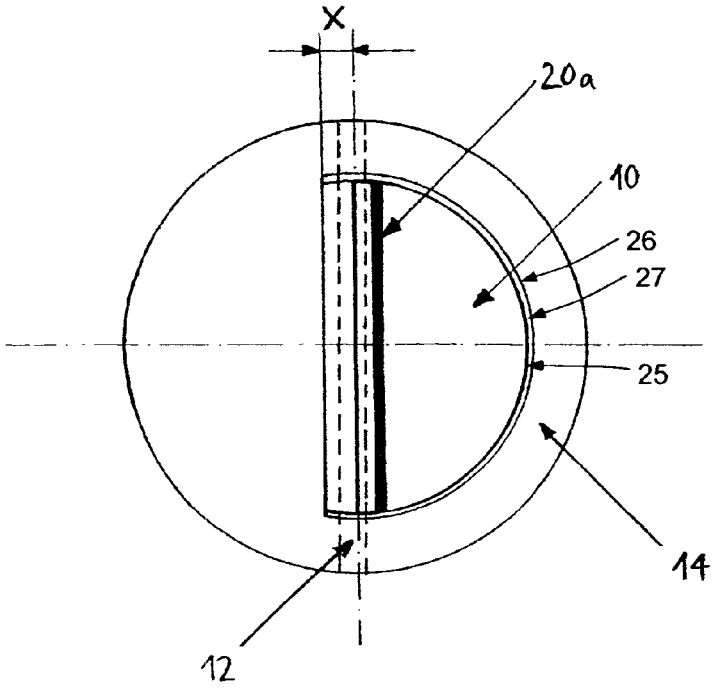
FIG. 3 shows the door stopper in a retracted position in top view.

FIG. 2 shows the door stopper 1 in a retracted position in cross section, and FIG. 3 in a top view: the door stopper 1 comprises a, for instance, rotationally cylindrical housing 11, having a housing bottom 22 and a cover plate 14. A tilting element 10 (or rocker) is disposed in the housing 11 rotatably about a rotational axis 12, a front lever 10*a* of the tilting element 10 lying in the region of an opening in the cover plate 14 and closing off this opening, and a rear lever 10*b* of the tilting element 10 lying below the cover plate 14. In a retracted position of the tilting element 10, the rear lever 10*b* bears against a lower limit 16 on the bottom side of the cover plate 14. A movement of the tilting element 10 is possible in which the tilting element 10 is tilted up with the front lever 10*a* and passes through the opening in the cover plate 14 until, twisted through a rotation angle 18, it butts against an upper limit 17, formed by a stop region 21 on the edge of the opening.

In the region of the lower limit 16, as well as of the upper limit 17, there are arranged inner stop elements 20 and outer stop elements 20*a* respectively, which cushion an impact of the tilting element 10 against the respective limit. To this end, the stop elements 20, 20*a* are preferably made of an elastic plastic and are embedded in or bonded into the tilting element 10 and/or the bottom side of the cover plate 14. FIG. 3 shows a horizontal distance X between the upper limit 17 and the rotational axis 12, which distance determines the maximum rotation angle 18.

The front lever 10*a* bears the buffer element 13, the rear lever 10*b* lies opposite the front lever 10*a* with respect to the rotational axis 12 and bears a trigger magnet 19.

The buffer element 13 is configured such that it follows the contour of the opening in the cover plate 14. When the buffer element 13 is tilted up through the rotation angle 18 about the rotational axis 12, the distance or gap 27 between the buffer element 13 (more precisely: an outer contour 25 of the buffer element) and that edge of the opening (more precisely: an inner contour 26 of the cover plate 14) which is opposite the buffer element 13 thereby remains substantially the same. At least, this distance does not, however, exceed a predefined measure.

The door leaf 3 equipped to interact with the door stopper 1 bears a trigger unit 7, which is preferably recessed in the door leaf 3 and hence is not visible. The trigger unit 7 comprises a trigger magnet 19. The trigger magnet 19 is sufficiently strong that it already acts on the door stopper magnet 19*a* in an approach region 2 before the trigger unit 7 is above the door stopper 1 or the tilting element 10. Preferably, the trigger magnet 19 is arranged such that a first magnetic pole, for instance the south pole, points downward. The door stopper magnet 19*a* is arranged the other way round, i.e. such that the same pole (in this example the south pole) points upward.

Figure 4:
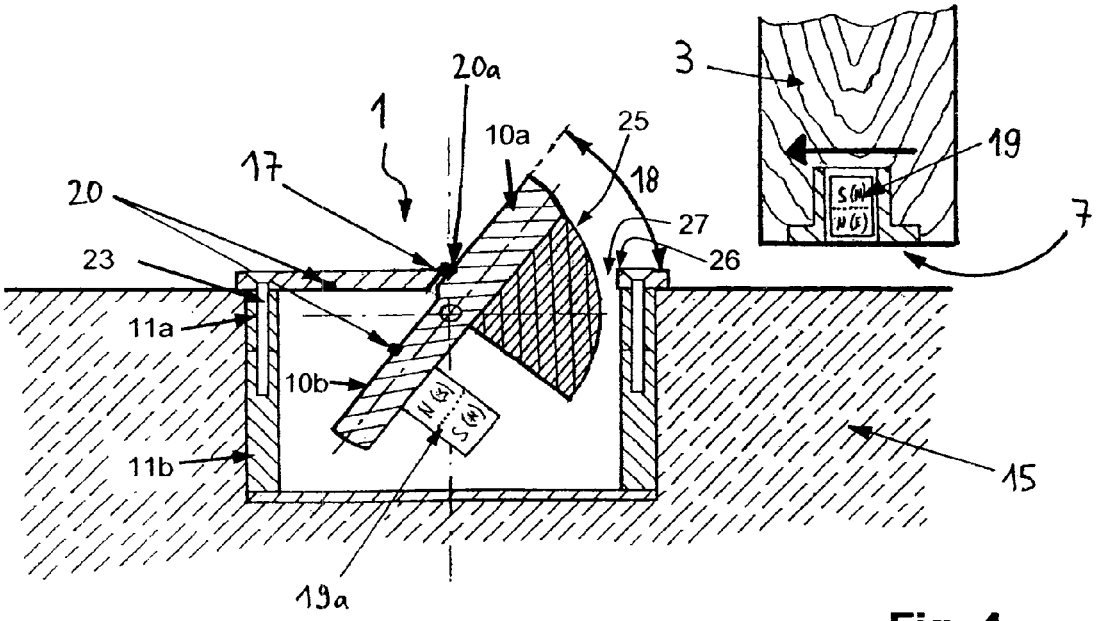
FIG. 4 shows the door stopper as a door is approaching.
Figure 6:
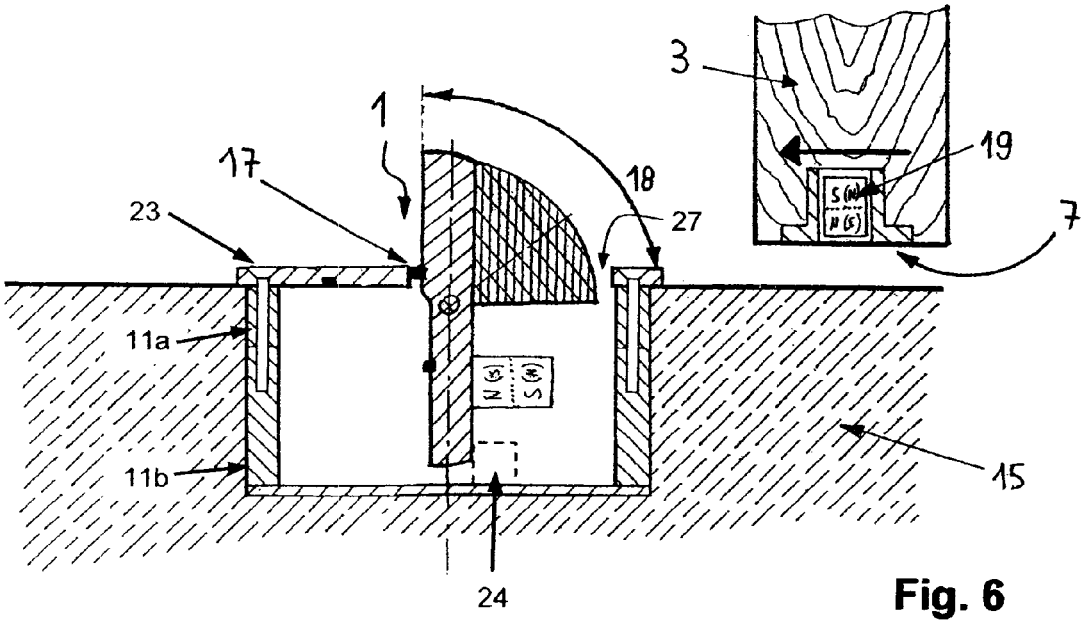
FIG. 6 shows another embodiment of the door stopper in the blocking position.

FIG. 4 shows the door stopper as a door approaches and as the trigger unit 7 impacts on the trigger magnet 19. The trigger magnet 19 draws the door stopper magnet 19*a* to it, whereupon the tilting element 10 rotates about the rotational axis 12 and the rear lever 10*b* with the door stopper magnet 19*a* moves a little way downward and in the direction of the trigger magnet 19. The rotation angle 18 of this movement which is shown in the figure is around 45°, preferably it is greater than 40° or 60°, and up to 90° in magnitude, as shown in FIG. 6.

Figure 5:
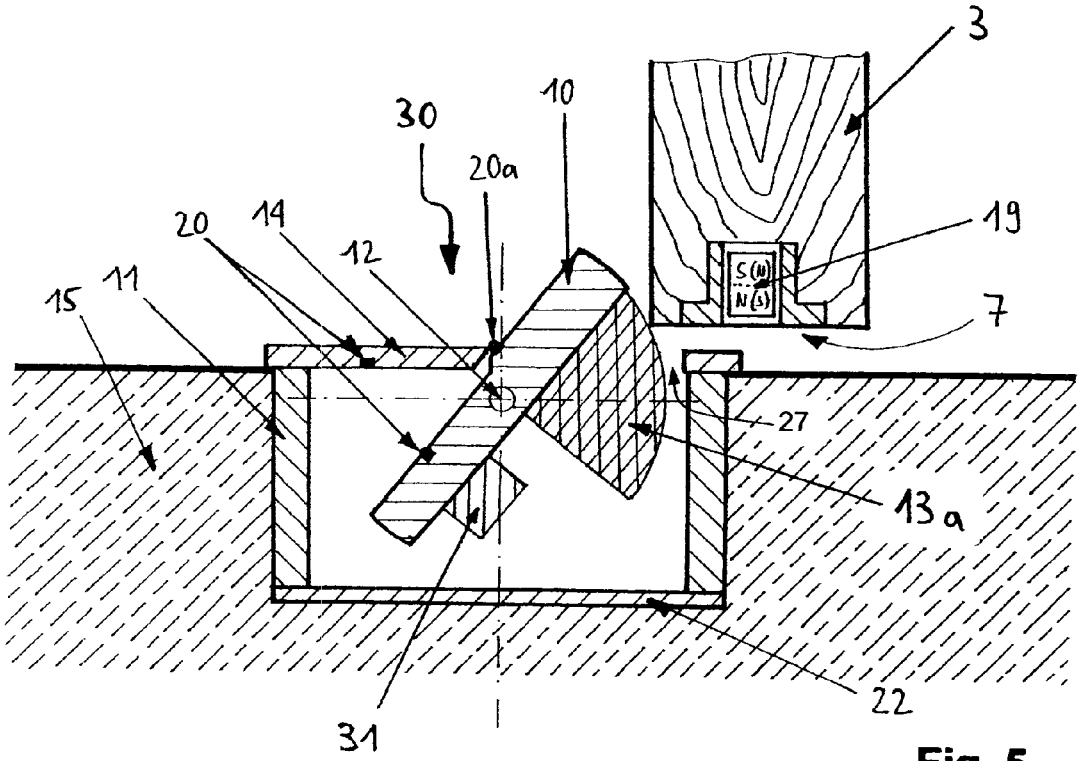
FIG. 5 shows the door stopper in a blocking position.

FIG. 5 shows the door stopper in a blocking position, in which the door leaf 3 butts against the buffer element 13 of the tilting element 10. Through the action of the two magnets 19, 19*a*, the buffer element 13 is preferably held in this position until a counterforce, which is applied, for instance, by hand or by a door closer, pulls the door leaf 3 back away from the door stopper 1.

The trigger magnet 19 can be configured as an electromagnet or as a permanent magnet, for instance made of a high-energy magnetic material having an energy product of at least 150 kJ/m$^3$, preferably at least 200 kJ/m$^3$ or at least 250 kJ/m$^3$. Such magnetic materials contain, for example, compounds containing elements of the rare earths; preferably, known high-energy magnetic materials such as samarium cobalt or neodymium iron boron are used.

In FIG. 5, in place of the door stopper magnet 19*a*, a ferromagnetic element 31, which is not a permanent magnet, is illustrated by way of example. Of course, this can also be present in the states according to the preceding figures. This ferromagnetic element 31, like the door stopper magnet 19*a*, due to the attraction by the trigger magnet 19, also causes the buffer element 13 to stand up. The other component parts of the door stopper 1 are here preferably made of a non-magnetic or non-magnetizable material, for instance aluminum, chromium steel, brass, etc., so that the magnetic flux of the trigger magnet 19 and the force generated thereby is focused on the element 31.

Alternatively or additionally, in place of the buffer element 13, a buffer element 13*a* having a magnetic or magnetizable core can also be present. This can be tilted up by the approach of the trigger unit 7.

FIG. 6 shows another embodiment of the door stopper 1 in the blocking position. The stop region 21 of the opening, which forms the upper limit 17, is set further back with respect to the rotational axis 12, so that the tilting element 10 can continue to be rotated until it butts (possibly with the optional outer stop element 20*a*) against the stop region 21 of the cover plate 14. Alternatively or additionally to this upper stop region 21, an inner stop 24 can also be arranged beneath the tilting element 10 (illustrated with dashed lines), which is arranged laterally, in single or double construction, so as not to collide with the retracted buffer element 13.

In FIGS. 4 and 6, the housing 11, by way of example, is illustrated in two-part construction, having an upper housing part 11*a* and a lower housing part 11*b* detachably connected to each other by fastening means such as screws 23. This division of the housing 11 is combinable, of course, with all embodiments.

REFERENCE SYMBOL LIST

1 door stopper
2 approach region
3 door leaf
4 line of movement
5 doorway
6 wheelchair
7 trigger unit
10 tilting element
10*a* front lever
10*b* rear lever
11 housing
11*a* upper housing part
11*b* lower housing part
12 rotational axis
13 buffer element
14 cover plate
15 foundation, floor
16 lower limit
17 upper limit
18 rotation angle
19 trigger magnet
19*a* door stopper magnet
20 inner stop element
20*a* outer stop element
21 stop region
22 housing bottom
23 screw
24 inner stop
25 outer contour of the buffer element
26 inner contour of the cover plate
27 gap
31 magnetizable element

The invention claimed is:

1. A retractable stopper configured to stop movement of a moving object, comprising:

a housing configured to be mounted on a floor;

a cover plate configured to cover part of the housing;

a tilting element rotatably mounted to the housing about a rotational axis, wherein the tilting element can be moved from a retracted position into a blocking position by the action of a trigger magnet, fastened to the moving object, by rotation through a rotation angle, and in this blocking position block the movement of the moving object, wherein the tilting element comprises a front lever and a rear lever connected to each other, the rear part resting against the cover plate when the tilting element is in the retracted position;

an elastic buffer element is disposed on the front part, and in the blocking position, is facing the moving object, wherein a stopper magnet or a magnetizable element is disposed on the tilting rear lever, and as the trigger magnet approaches over an approach region in front of the stopper, the magnetic field generated by the tilting element is configured to act against the stopper magnet or magnetizable element to make the tilting element rotate out of the retracted position into the blocking position before the trigger magnet is above the tilting element.

2. The retractable stopper as claimed in claim 1, wherein:

the tilting element comprises the front lever and the rear lever, which lie opposite each other with respect to the rotational axis, and the stopper magnet or the magnetizable element, when the trigger magnet is present in an approach region in front of the stopper, exerts on the tilting element a force which draws the rear lever downward and thereby tilts the front lever upward.

3. The retractable stopper as claimed in claim 1, wherein, over the full range of the rotation angle, an outer contour of the buffer element is configured such that it follows the shape of an inner contour of the cover plate.

4. The retractable stopper as claimed in claim 1, wherein the shape of that surface of the buffer element which is facing the moving object is defined by rotation of a boundary line about the rotational axis.

5. The retractable stopper as claimed in claim 3, wherein the buffer element has the shape of a spherical segment.

6. The retractable stopper as claimed in claim 1, wherein a rotation angle through which the tilting element is pivotable from the retracted position into the blocking position measures between 40° and 90°.

7. The retractable stopper as claimed in claim 1, wherein an upper side of the front lever, in the retracted position, is aligned with a fixedly mounted cover plate and butts in the blocking position against an upper limit configured on the cover plate.

8. The retractable stopper as claimed in claim 7, wherein on the cover plate and/or on the upper side of the front lever there is arranged an outer stop element for cushioning the impact of the front lever against the upper limit in the blocking position.

9. The retractable stopper as claimed in claim 7, wherein on a bottom side of the cover plate and/or on a top side of the rear lever there is arranged an inner stop element for cushioning the impact of the rear lever against the cover plate in the retracted position.

10. The retractable stopper as claimed in claim 1, wherein the trigger magnet is an electromagnet.

11. The retractable stopper as claimed in claim 1, wherein a housing and/or the tilting element is formed of aluminum or another non-ferromagnetic material, and the cover plate is formed of stainless steel.

12. The retractable stopper as claimed in claim 1, wherein the tilting element is arranged rotatably about the rotational axis in a housing, the housing comprises an upper housing part and a lower housing part, and, for the fitting of the stopper in a foundation, first the lower housing part can be fastened in the foundation and then the upper housing part can be detachably fastened to the lower housing part.

* * * * *